US008363858B2

(12) United States Patent
Akino

(10) Patent No.: US 8,363,858 B2
(45) Date of Patent: Jan. 29, 2013

(54) DIAPHRAGM FOR CONDENSER MICROPHONE, AND CONDENSER MICROPHONE

(75) Inventor: Hiroshi Akino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 582 days.

(21) Appl. No.: 12/453,628

(22) Filed: May 18, 2009

(65) Prior Publication Data

US 2009/0296963 A1 Dec. 3, 2009

(30) Foreign Application Priority Data

May 30, 2008 (JP) ..... 2008-142067

(51) Int. Cl.
*H04R 25/00* (2006.01)

(52) U.S. Cl. ..... 381/174; 381/423

(58) Field of Classification Search ..... 381/174, 381/423

See application file for complete search history.

(56) References Cited

U.S. PATENT DOCUMENTS

| | | | | |
|---|---|---|---|---|
| 1,975,801 | A * | 10/1934 | Rieber | 381/174 |
| 2007/0217647 | A1* | 9/2007 | Enomoto et al. | 381/410 |
| 2009/0141914 | A1* | 6/2009 | Akino | 381/176 |
| 2009/0208038 | A1* | 8/2009 | Akino | 381/176 |

FOREIGN PATENT DOCUMENTS

| | | |
|---|---|---|
| JP | 2681207 | 8/1997 |

* cited by examiner

*Primary Examiner* — Eugene Lee
*Assistant Examiner* — Elias M Ullah
(74) *Attorney, Agent, or Firm* — Manabu Kanesaka

(57) ABSTRACT

The adsorption stability with respect to a fixed pole is increased while the low frequency response of a diaphragm is improved especially in an electret condenser microphone. In a diaphragm 11 for a condenser microphone, which is formed of a thermoplastic resin film having a metal film on one surface thereof, a first irregularity pattern 12 consisting of rough irregularities 12*a* having a long period and a second irregularity pattern 13 consisting of fine irregularities 13*a* having a short period are formed over the whole region of the diaphragm 11.

9 Claims, 2 Drawing Sheets

DIAPHRAGM FOR CONDENSER MICROPHONE, AND CONDENSER MICROPHONE

CROSS-REFERENCE TO RELATED APPLICATION

The present application is based on, and claims priority from, Japanese Application Serial Number JP2008-142067, filed May 30, 2008, the disclosure of which is hereby incorporated by reference herein in its entirety.

TECHNICAL FIELD

The present invention relates to a diaphragm for a condenser microphone, and a condenser microphone. More particularly, it relates to a technique for increasing adsorption stability with respect to a fixed pole while improving the low frequency response of a diaphragm.

BACKGROUND ART

A condenser microphone includes an electrostatic type acousto-electric transducer. The acousto-electric transducer includes a diaphragm and a fixed pole that are arranged oppositely via a spacer ring. The fixed pole is spreadingly provided on a support ring (diaphragm ring) under a predetermined tension.

As the diaphragm, a thermoplastic resin film consisting of polyethylene terephthalate or polyphenylene sulfide having a thickness of, for example, 3 to 6 μm, on one surface of which a deposit film is formed by depositing metal, is used. As a general fixed pole, an electrode plate made of a metal such as aluminum is used. In particular, in the case of an electret condenser microphone, an electret dielectric film is integrally provided on the surface (surface opposed to the diaphragm) of the fixed pole.

The electret dielectric film has specific properties (self-polarization properties) of becoming in a polarized state due to corona discharge or the like if a DC high voltage is applied and keeping the polarized state even after the removal of applied voltage.

Generally, it is demanded to install the diaphragm to the support ring under a low tension to position the low limit at a low frequency. However, the fixed pole is arranged on the back surface of the diaphragm, and a polarization voltage due to electret exists between the diaphragm and the fixed pole. Therefore, an electrostatic attraction force is applied to the diaphragm, so that a problem of so-called adsorption of diaphragm to fixed pole occurs.

To solve this problem, Patent Document 1 (Japanese Patent No. 2681207) discloses a technique in which a large number of fine irregularities are formed over the whole region of the diaphragm. The irregularities are provided so that the height from the bottom of a concave part to the top of a convex part is larger than the thickness of the diaphragm.

According to this configuration, under the condition that the low frequency response is the same, the diaphragm provided with irregularities can increase the adsorption stability about 20% as compared with the diaphragm provided with no irregularities. This means that the polarization voltage due to electret can be increased about 20%, thereby increasing the sensitivity by about 2 dB.

However, in the electret condenser microphone, partial variations occur easily in the external electric field due to the electret on the surface of the fixed pole, and the diaphragm is adsorbed in a portion in which the external electric field is high.

Accordingly, a problem with the present invention is to increase the adsorption stability with respect to a fixed pole while improving the low frequency response of a diaphragm especially in an electret condenser microphone.

SUMMARY OF THE INVENTION

To solve the above problem, the present invention provides a diaphragm for a condenser microphone, which is formed of a thermoplastic resin film having a metal film on one surface, wherein a first irregularity pattern comprising rough irregularities having a long period and a second irregularity pattern comprising fine irregularities having a short period are formed over the whole region of the diaphragm.

As a preferable mode, the ratio of period between the first irregularity pattern and the second irregularity pattern is not less than 10.

Furthermore, it is preferable that the first irregularity pattern take a hexagonal tortoiseshell pattern, and the second irregularity pattern take a mesh pattern transferred from a mesh material.

The present invention also embraces a method for manufacturing a diaphragm for a condenser microphone. That is to say, the present invention provides a method for manufacturing a diaphragm for a condenser microphone, which is formed of a thermoplastic resin film having a metal film on one surface, wherein the method is carried out by using an apparatus having a heating means and a cooling means, and including a mold for forming a first irregularity pattern comprising rough irregularities having a long period over the whole region of the diaphragm; a soft mesh material, which is deformable along the first irregularity pattern, for forming a second irregularity pattern comprising fine irregularities having a short period over the whole region of the diaphragm; and a pressurizing pot which is connected to a compressed air source and is arranged above the mold so as to be capable of being raised and lowered, and the method includes the steps of arranging the mesh material on the mold; placing the diaphragm on the mesh material; heating the mold to a temperature capable of softening the diaphragm by using the heating means; lowering the pressurizing pot and pressing the diaphragm against the mold together with the mesh material by pressurized air to form the first irregularity pattern and the second irregularity pattern on the diaphragm; and cooling the mold to a predetermined temperature by the cooling means.

Furthermore, the present invention embraces a condenser microphone using the above-described diaphragm. That is to say, in a condenser microphone having an acousto-electric transducer in which a diaphragm spreadingly provided on a support ring under a predetermined tension and a fixed pole are arranged oppositely via a spacer, the diaphragm described above is provided.

According to the present invention, the first irregularity pattern comprising rough irregularities having a long period (preferably, a hexagonal tortoiseshell pattern) is formed. Therefore, even if partial variations occur in the external electric field due to the electret on the surface of the fixed pole, partial adsorption in a portion in which the external electric field is high can be eliminated.

Also, the second irregularity pattern comprising fine irregularities having a short period (preferably, a mesh pattern transferred from the mesh material) is formed so as to be superposed on the first irregularity pattern. Therefore, the adsorption stability can be increased about 10 to 15% as compared with the invention described in Patent Document 1 in which only the second irregularity pattern is formed.

DETAILED DESCRIPTION

Figure 1:
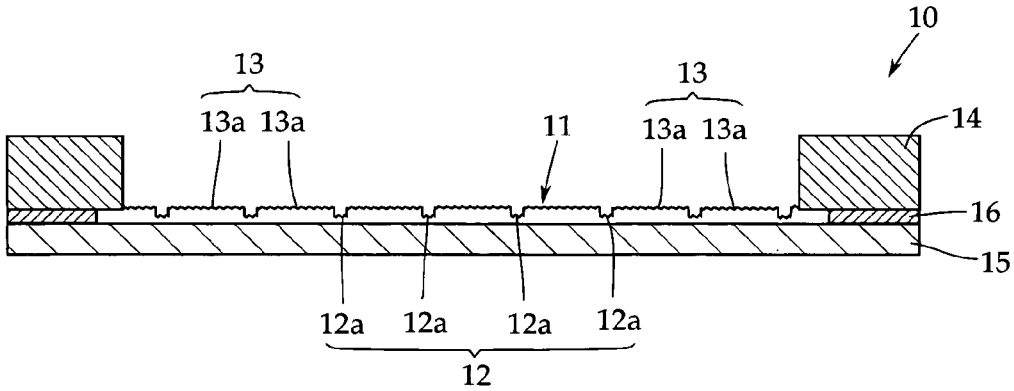
FIG. 1 is a schematic sectional view of an acousto-electric transducer of condenser microphone including a diaphragm in accordance with the present invention.

An embodiment of the present invention will now be described, however, the present invention is not limited to this embodiment. Referring to FIG. 1, an acousto-electric transducer 10 includes a diaphragm 11 and a fixed pole 15 as a basic configuration.

On the diaphragm 11, a gold deposit film (not shown) comprising a thermoplastic resin film having a thickness of about 3 to 6 μm, is formed on one surface. As one example of the thermoplastic resin film, polyethylene terephthalate and polyphenylene sulfide can be cited.

The fixed pole 15 consists of an electrode plate formed of, for example, aluminum. In the case of an electret condenser microphone, an electret dielectric film (not shown) consisting of FEP or the like is integrally affixed to the surface (surface opposed to the diaphragm 11) of the fixed pole 15.

The diaphragm 11 is spreadingly provided in the state in which a predetermined tension is applied to a metallic support ring (diaphragm ring) 14. The diaphragm 11 is arranged so as to be opposed to the fixed pole 15 via an electrical insulating spacer ring 16. By the diaphragm 11 and the fixed pole 15, a kind of condenser is formed.

On the diaphragm 11, a first irregularity pattern 12 and a second irregularity pattern 13 are formed over the whole region thereof. The first irregularity pattern 12 consists of rough irregularities 12*a* having a long period, and the second irregularity pattern 13 consists of fine irregularities 13*a* having a short period.

Figure 3A:
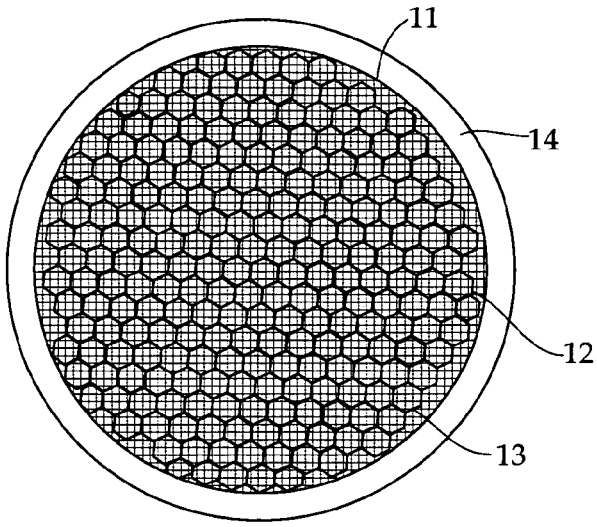
FIG. 3A is a plan view of a diaphragm in accordance with the present invention.
Figure 3B:
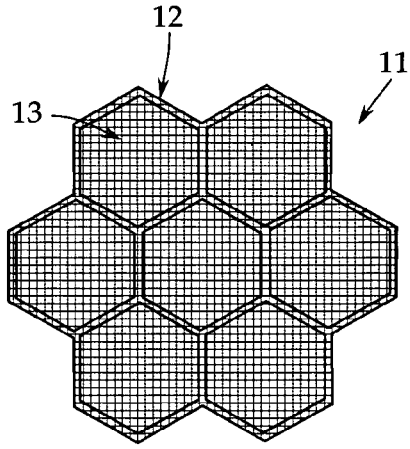
FIG. 3B is an enlarged plan view showing a part of the diaphragm shown in FIG. 3A.
Figure 3C:
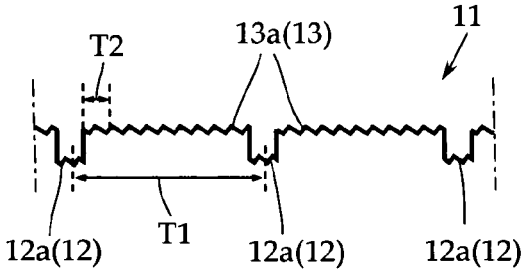
FIG. 3C is an enlarged sectional view showing a part of the diaphragm shown in FIG. 3A.

Referring to FIG. 3C, taking the period (one pitch) of the first irregularity pattern 12 as T1 and the period (one pitch) of the second irregularity pattern 13 as T2, the period T1 of the first irregularity pattern 12 is preferably longer than the period T2 of the second irregularity pattern 13. Further preferably, the period T1 should be 10 times or more the period T2. That is to say, it is preferable that ten or more irregularities 13*a* be present between the adjacent irregularities 12*a*, 12*a*.

Regarding the difference in height between irregularities, the irregularities 12*a* of the first irregularity pattern 12 have a large difference in height of irregularities, that is, being formed so as to be rough. In contrast, the irregularities 13*a* of the second irregularity pattern 13 have a small difference in height of irregularities, that is, being formed so as to be fine.

For the irregularities 13*a* of the second irregularity pattern 13, like the invention described in Patent Document 1, it is preferable that the height (height difference) from the bottom of a concave part to the top of a convex part be larger than the thickness of the diaphragm, and the irregularities 13*a* be provided in large numbers.

The directions of the irregularities 12*a* and the irregularities 13*a* are relative. That is, for example in FIG. 3C, if a portion directed downward (to the fixed pole 15 side) is taken as the concave part, a portion directed upward (to the opposite side to the fixed pole 15) is the convex part. In this embodiment, the period (one pitch) T1 of the first irregularity pattern 12 is a distance between the adjacent concave parts, and the period (one pitch) T2 of the second irregularity pattern 13 is a distance between the adjacent concave parts or between the adjacent convex parts.

As shown in FIG. 3C, the irregularities 13*a* of the second irregularity pattern 13 are formed over the whole region of the diaphragm 11 including portions of the irregularities 12*a* of the first irregularity pattern 12. That is to say, the irregularities 13*a* of the second irregularity pattern 13 are formed so as to be superposed on the irregularities 12*a* of the first irregularity pattern 12.

Figure 2:
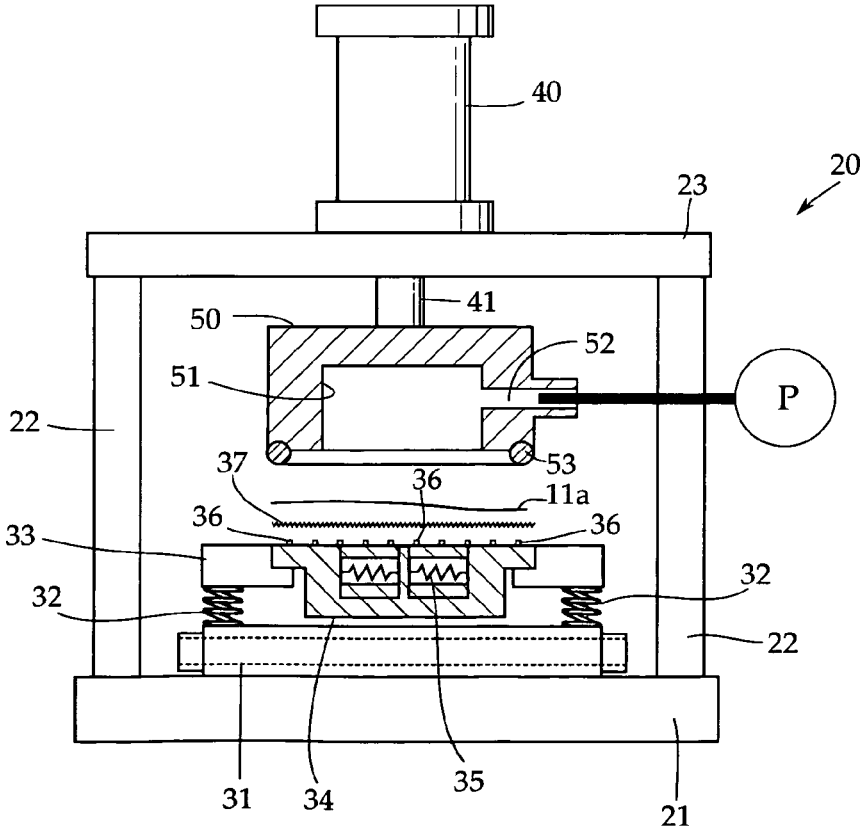
FIG. 2 is a schematic front view showing one example of a diaphragm manufacturing apparatus used in the present invention.

Referring to FIG. 2, a diaphragm manufacturing apparatus 20 includes a lower base 21, side frames 22, 22 erected from the right and left of the lower base 21, and an upper base 23 provided between the top ends of the side frames 22, 22 so as to be parallel with the lower base 21.

On the upper surface of the lower base 21 is arranged a cooling means 31 in which a cooling water pipe, not shown, is laid around. Above the cooling means 31, a support 33 is provided. The support 33 is supported at four corners via springs 32 so that the whole thereof can be raised and lowered.

In the central part of the support 33, an opening is provided, and in this opening, a molding tool 34 is supported. The molding tool 34 is a mold made of a metal (preferably, brass), and includes a heating means 35 consisting of, for example, an electric heater. When the molding tool 34 is lowered, a power source for the heating means 35 is turned off, and the bottom surface of the molding tool 34 comes into contact with the cooling means 31.

On the surface (upper surface) of the molding tool 34, ribs 36 for forming the first irregularity pattern 12 are provided. The ribs 36 are formed into ridges that are parallel with each other in a predetermined direction to form the continuous rough irregularities 12*a* having a long period on a diaphragm raw material (mother plate for the diaphragm 11) 11*a*. The ribs 36 are fabricated by etching or the like method.

In this embodiment, the ribs 36 are formed into a hexagonal tortoiseshell pattern when viewing the molding tool 34 from above. As one example, a continuous pattern of hexagons each having one side of about 1 mm appearing in "Pattern No. 6 on page 1 of line patterns of sample book" of Nihon Etching Co., Ltd. is preferred. However, the ribs 36 may be formed into any other polygonal shape.

Over the molding tool 34, a mesh material 37 for forming the second irregularity pattern 13 is arranged. The mesh material 37 has flexibility so as to be deformed easily following the ribs 36 forming the first irregularity pattern 12. As the mesh material 37, a nylon mesh is preferably used.

As a preferred nylon mesh, "nylon mesh No. S508S" manufactured by NCB Industry can be cited typically. In this embodiment, the mesh material 37 is detachably arranged over the molding tool 34. However, the mesh material 37 may be fixed to the molding tool 34 by using, for example, an adhesive.

In the substantially central portion on the upper base 23, an air cylinder 40 is mounted. A cylinder rod 41 of the air cylinder 40 extends downward (to the lower base 21 side) penetrating the upper base 23, and at the lower end thereof, a pressurizing pot 50 serving as a pressurizing means is installed.

The pressurizing pot 50 has a pressurizing chamber 51 the lower surface of which is open, and is provided with an O-ring 53 for a hermitic seal on the open end side thereof. The pressurizing pot 50 has a pressurizing air supply port 52 connected to a pressurizing pump P comprising a compressed air source.

Next, a method for manufacturing the diaphragm is explained. The diaphragm raw material (mother plate for the diaphragm 11) 11*a* is a thermoplastic resin film having a thickness of about 3 to 6 μm, which is made of polyphenylene sulfide (PPS), used as a base, one surface of which is formed with a gold deposit film formed by depositing a gold thin film.

First, the mesh material 37 is arranged on the surface formed with the ribs 36 of the molding tool 34, and the diaphragm raw material 11*a* is placed on the mesh material 37.

Next, the heating means (electric heater) 35 is energized to raise the temperature of the molding tool 34 to a temperature capable of molding the diaphragm raw material 11*a* (about 160° C. in this example), by which the diaphragm raw material 11*a* is softened. At this time, it is preferable that the diaphragm raw material 11*a* be fixed to the molding tool 34 by using a negative-pressure adsorbing means, not shown, to prevent wrinkles from occurring on the diaphragm raw material 11*a* during the heating process.

Thereafter, the pressurizing pot 50 is lowered by using the air cylinder 40, and then the pressurizing pump P is started to send pressurized air (in this example, the air pressure is 9 $kg/cm^2$) from the pressurizing chamber 51 toward the diaphragm raw material 11*a*, and thereby the diaphragm raw material 11*a* is pressed against the molding tool 34 together with the mesh material 37.

Thereby, the first irregularity pattern 12 is formed on the diaphragm raw material 11*a* by the ribs 36 of the molding tool 34, and the second irregularity pattern 13 is formed thereon by the mesh material 37.

When the pressurizing pot 50 is lowered, the heating means 35 is automatically deenergized, whereby the molding tool 34 is cooled to a predetermined temperature (about 55° C. in this example) by the cooling means 31. Thereafter, the pressurizing pump P is turned off, and the air cylinder 40 is raised to separate the diaphragm raw material 11*a* from the mesh material 37.

According to this method, as shown in FIGS. 3A and 3B, on the diaphragm raw material 11*a*, the first irregularity pattern 12 consisting of a tortoiseshell pattern of hexagons each having one side of about 1 mm is formed by the ribs 36 of the molding tool 34 and the second irregularity pattern 13 consisting of fine meshes is formed by the mesh material 37.

Subsequently, the support ring 14 is installed to the diaphragm raw material 11*a* via an adhesive in the state in which a predetermined tension is applied to the diaphragm raw material 11*a*. After the adhesive has cured, the diaphragm 11 is cut out of the diaphragm raw material 11*a* along the support ring 14. By performing a series of the above-described operations, the diaphragm 11 can be manufactured.

According to the present invention, by using the diaphragm 11 having the above-described configuration, the low frequency response is improved, and also the adsorption stability with respect to the fixed pole 15 is increased. Therefore, a highly sensitive condenser microphone is provided.

The invention claimed is:

1. A diaphragm for a condenser microphone, comprising:

a thermoplastic resin film having a metal film on one surface, wherein a first irregularity pattern comprising rough irregularities having a long period and a second irregularity pattern comprising fine irregularities having a short period are formed over a whole region of the diaphragm, and the fine irregularities are formed over the whole region including the rough irregularities, and the rough irregularities of the first irregularity pattern have a height in a thickness direction of the diaphragm greater than that of the fine irregularities of the second irregularity pattern.

2. The diaphragm for a condenser microphone according to claim 1, wherein a ratio of period between the first irregularity pattern and the second irregularity pattern is not less than 10.

3. The diaphragm for a condenser microphone according to claim 1, wherein the first irregularity pattern takes a hexagonal tortoiseshell pattern, and the second irregularity pattern takes a mesh pattern transferred from a mesh material.

4. A condenser microphone having an acousto-electric transducer in which a diaphragm spreadingly provided on a support ring under a predetermined tension and a fixed pole are arranged oppositely via a spacer, wherein as the diaphragm, the diaphragm according to claim 1 is provided.

5. The diaphragm for a condenser microphone according to claim 1, wherein the first and second irregularity patterns are projections and dents integrally formed with the diaphragm, the first irregularity pattern having a height and a lateral pitch, greater than those of the second irregularity pattern.

6. A diaphragm for a condenser microphone, comprising:

a diaphragm member including a thermoplastic resin film and a metal film formed on one surface of the resin film, a first irregularity pattern integrally formed with the diaphragm member and having a first pitch, and a second irregularity pattern integrally formed with the diaphragm member and having a second pitch shorter than the first pitch, the second irregularity pattern being formed over a whole region of the diaphragm member including the first irregularity pattern, wherein the first irregularity pattern has a height in a thickness direction of the diaphragm greater than that of the second irregularity pattern.

7. The diaphragm for a condenser microphone according to claim 6, wherein the first and second irregularity patterns are projections and dents integrally formed with the diaphragm, the first irregularity pattern having a height and a lateral pitch, greater than those of the second irregularity pattern.

8. The diaphragm for a condenser microphone according to claim 7, wherein the first irregularity pattern takes a hexagonal tortoiseshell pattern, and the second irregularity pattern takes a mesh pattern.

9. A condenser microphone comprising:

an acousto-electric transducer including a support ring, the diaphragm according to claim 6 and spreadingly provided on the support ring under a predetermined tension, and a fixed pole arranged on the diaphragm at a side opposite to the support ring via a spacer.

* * * * *